US011242699B2

(12) United States Patent
Weichsel

(10) Patent No.: US 11,242,699 B2
(45) Date of Patent: Feb. 8, 2022

(54) CLOSING AID FOR MOTOR VEHICLES

(71) Applicant: Kiekert AG, Heiligenhaus (DE)

(72) Inventor: Ulrich Weichsel, Duisburg (DE)

(73) Assignee: Kiekert AG, Heiligenhaus (DE)

( * ) Notice: Subject to any disclaimer, the term of this patent is extended or adjusted under 35 U.S.C. 154(b) by 630 days.

(21) Appl. No.: 16/095,396

(22) PCT Filed: Mar. 22, 2017

(86) PCT No.: PCT/DE2017/100232
§ 371 (c)(1),
(2) Date: Oct. 22, 2018

(87) PCT Pub. No.: WO2017/182023
PCT Pub. Date: Oct. 26, 2017

(65) Prior Publication Data

US 2019/0136587 A1 May 9, 2019

(30) Foreign Application Priority Data

Apr. 22, 2016 (DE) ..... 10 2016 107 507.8

(51) Int. Cl.
*E05B 81/20* (2014.01)
*E05B 81/14* (2014.01)
*E05B 81/06* (2014.01)

(52) U.S. Cl.
CPC ..... *E05B 81/20* (2013.01); *E05B 81/14* (2013.01); *E05B 81/06* (2013.01)

(58) Field of Classification Search
CPC ..... E05B 81/20; E05B 81/14; E05B 81/06; E05B 17/0029; E05B 77/22
(Continued)

(56) References Cited

U.S. PATENT DOCUMENTS 8,844,984 B2 * 9/2014 Kurebayashi ..... E05B 81/20 292/201
2011/0084504 A1 4/2011 Kurebayashi et al.
(Continued)

FOREIGN PATENT DOCUMENTS

CN 101680246 A 3/2010
CN 102312619 B 1/2012
(Continued)

OTHER PUBLICATIONS

Translation of Notice of Reasons for Rejection dated Sep. 8, 2020, for corresponding Japanese Patent Application No. 2018-555143.
(Continued)

*Primary Examiner* — Kristina R Fulton
*Assistant Examiner* — Emily G. Brown
(74) *Attorney, Agent, or Firm* — Renner, Otto, Boisselle & Sklar, LLP

(57) ABSTRACT

A closing aid for a motor-vehicle lock enables fast opening for a lock having a rotary latch. The rotary latch is latched by at least one pawl in a preliminary latching position and in a main latching position. The closing aid comprises a motor, by which the rotary latch is moved by motor force from the preliminary latching position into the main latching position such that an associated door or flap of a motor vehicle can be closed. The closing aid has a movable closing pawl for closing by motor force. By the motion of the closing pawl by the motor from an initial position into an end position along a first path, the rotary latch is brought from the preliminary latching position into the main latching position. The return motion of the closing pawl from the end position into the initial position occurs along a different, second path.

13 Claims, 3 Drawing Sheets

(58) Field of Classification Search
USPC ..... 292/201, 216
See application file for complete search history.

(56) References Cited

U.S. PATENT DOCUMENTS

| | | | | |
|---|---|---|---|---|
| 2013/0076045 | A1* | 3/2013 | Torka | E05B 77/36 292/96 |
| 2018/0058116 | A1* | 3/2018 | Erices | E05B 79/20 |

FOREIGN PATENT DOCUMENTS

| | | | |
|---|---|---|---|
| DE | 102007003948 | | 5/2008 |
| DE | 102008048772 | | 3/2010 |
| DE | 102008048773 | | 3/2010 |
| DE | 102012216976 | A1 | 4/2014 |
| EP | 2503082 | | 9/2012 |
| JP | 2009299313 | A | 12/2009 |
| WO | 2010142280 | | 12/2010 |
| WO | 2015139678 | A1 | 9/2015 |

OTHER PUBLICATIONS

International Search Report and Written Opinion for corresponding Patent Application No. PCT/DE2017/100232 dated Jun. 23, 2017.

* cited by examiner

CLOSING AID FOR MOTOR VEHICLES

FIELD OF DISCLOSURE

The invention relates to a closing aid for a motor vehicle lock with a locking mechanism. The locking mechanism comprises a rotary latch and at least one pawl. The invention furthermore relates to a motor vehicle lock with a closing aid. The rotary latch of such a lock can be ratcheted in a preliminary latching position and a main latching position by means of the pawl. Such a lock is in particular a lock for a motor vehicle door.

BACKGROUND OF DISCLOSURE

A rotary latch of a motor vehicle lock has a fork-shaped inlet slot into which a locking bolt of a motor vehicle door or motor vehicle flap enters when the motor vehicle door or motor vehicle flap is closed. The locking bolt then rotates the rotary latch from an open position to a closed position. If the rotary latch has reached a closed position, the locking bolt can thus no longer leave the inlet slot of the rotary latch. In the closed position, a pawl ratchets the rotary latch. Consequently, it can no longer be rotated back into the opening position.

On a motor vehicle lock, there are regularly two ratchet positions which can be assumed consecutively during closure of the rotary latch, i.e. the so-called preliminary latching position and the so-called main latching position. It is possible that only one pawl is present which is capable of ratcheting the rotary latch in the preliminary latching position and in the main latching position. However, two pawls can also be provided for, whereby the first pawl can ratchet the rotary latch in the preliminary latching position and the second pawl can ratchet the rotary latch in the main latching position. A lock with a pawl for the main ratchet, a pawl for the pre-ratchet and a blocking lever for the main ratchet—pawl is known from the publication DE 10 2007 003 948 A1.

A closing aid for a lock of the type described above is known from publication WO 2010/142280 A1. The closing aid encompasses a drive with which the rotary latch can be moved by motor force from the preliminary latching position into the main latching position, in order to thus completely close a pertaining door or flap. The drive encompasses a closing pawl which can be moved by the motor, which is known as a bracket. During closure, the closing pawl lies adjacent on a bolt of the rotary latch, so that by motorized movement of the closing pawl the rotary latch can be rotated from the preliminary latching position into the main latching position. The closing pawl is subsequently moved back into its initial position. If the closing pawl has reached its initial position, the lock can thus be opened again.

The movement of the closing pawl back into its initial position requires time. The lock cannot be opened in this time.

Furthermore, closing aids are known from publications DE 10 2008 048 773 A1 and DE 10 2008 048 772 A1.

SUMMARY OF DISCLOSURE

It is an object of the invention to provide a closing aid for a motor vehicle lock which enables rapid opening.

The object of the invention is solved by the object with the characteristics of the first claim. Advantageous embodiments result from the dependent claims. Unless stated otherwise hereinafter, the object of the invention can encompass one or several of the aforementioned characteristics.

A closing aid is created for a lock with a rotary latch to solve the object. The rotary latch can be ratcheted by at least a pawl in a preliminary latching position and in a main latching position. The closing aid has a motor by means of which the rotary latch can be moved by motorized force directly or indirectly from the preliminary latching position and the main latching position in order to thus be able to close a pertaining door or flap of a motor vehicle. The closing aid has a movable closing pawl for closure by the motor.

By means of movement of the closure aid with the aid of the motor from an initial position into an end position along a first path the rotary latch is moved from the preliminary latching position into the main latching position. The closing pawl is moved back from the end position into the initial position along another second path. The moving back can take place, for example, by motorized force and/or by the force of a pre-tensioned spring.

The first path of the closing pawl is now selected in such a way that the rotary latch is moved from the pre-ratchet to the main ratchet as a result. The second path of the closing pawl is selected such that the closing pawl is disengaged prematurely, in particular prematurely before attainment of the initial position. As soon as the closing aid is disengaged, the lock can be opened. It must therefore not be awaited until the closing pawl has reached its initial position again in order to be able to open the lock.

The movement of the closing pawl is preferably controlled by one or several control contours. The different paths can thus be executed in a technically simple manner. In particular, pivoting movements of the closing pawl are controlled in order to be able to thus disengage the closing pawl especially quickly as soon as the rotary latch has been moved into the main latching position by the closing aid. However, the closing pawl can also be disengaged with an ejection device, for example by an impact in order to enable premature opening of the pertaining lock again by the disengagement.

Movement of the closing pawl along the first path runs preferably in such a way that the closing pawl lies adjacent on a first control contour during the movement and/or the movement of the closing pawl along the second path runs in such a way that the closing pawl lies adjacent during the movement on a second control contour. The first control contour acts as a guide for the closing pawl such that the closing pawl is moved along the first path from the initial position into the end position. The second control contour acts as a guide for the closing pawl such that the closing pawl is moved along the second path from the end position into the initial position. By means of two different control contours different paths can be executed for the closing pawl in a technically simple manner with little installation space in order to go from the initial position to the end position on the first path and back from the end position to the initial position on the other second path.

Both control contours are preferably movably accommodated. Hereby it can be simply attained that the closing pawl is guided through a first control contour on the outward route from the initial position to the end position and on the return route from the end position back into the initial position by a second other control contour by suitable movement of the two control contours.

A suitable movement of the two control contours succeeds in particular by attachment of the two control contours onto a pivotably accommodated lever. If the lever is pivoted, the two control contours are thus moved.

Both mobile control contours and/or the closing pawl are pre-tensioned in one design by a spring in the direction of a third control contour in order to thus enable safe operation. By means of one or several pre-tensioned springs the mobile control contours and/or the closing pawl can be moved in the direction of the third control contour. The third control contour also controls a movement of the closing pawl, in particular along the first path. The third control contour is fundamentally accommodated in an immobile manner, i.e. attached firmly.

In one design, the pivotable lever is pivoted when the closing pawl is moved from the initial position into the end position. This contributes to the closing pawl being guided along the first path by a first control contour in a technically simple manner. However, it is also alternatively or additionally possible that the pivotable lever is pivoted during the movement along the second path in order to thus suitably control movement processes.

In one design, the pivotable lever is pivoted in a second rotational direction when the closing pawl is moved from the end position into the initial position. This pivoting in the second rotational direction can occur before and/or during movement of the closing pawl from the initial position into the end position. This contributes to the closing pawl being guided along the first path by a first control contour in a technically simple manner. This second rotational direction is opposite the aforementioned first rotational direction.

In particular, both contours have an arch shape, whereby the ends of the arch shapes discharge into one another so that an ellipse-like shape is present, such as an oval, for example. Acute-angled ends are present at least approximately which can simply contribute to the closing pawl being guided by the first control contour on the outward route and by the second control contour on the return route.

In an advantageous embodiment, the closing pawl has a protruding bolt which lies adjacent on the relevant aforementioned control contour during movement of the closing pawl. The control contours can therefore guide the bolt and thus the closing pawl in the course of movement of the closing pawl. This can simply be further improved in such a way that on the outward route the closing pawl is by the first control contour and on the return route by the second control contour.

In an advantageous embodiment, the bolt has a circular or drop-shaped cross-section which contributes in a further improved manner to the closing pawl being guided by the first control contour on the outward route and by the second control contour on the return route.

In one embodiment, the closing pawl is pivotably accommodated by an axis. Movement of the closing pawl along the first path and/or the second path encompasses a rotational movement around the axis and a shifting (i.e. relocation) of this axis. The closing aid can thus be moved along different paths with simple technical means.

The invention also relates to a lock with such a closing aid. During closure in one configuration, the closing pawl is directly adjacent on the rotary latch in order to minimize the number of components and thus also the installation space. However, between the closing pawl and the rotary latch at least one further component can be provided for by means of which a movement of the closing pawl is transferred onto the rotary latch for closure.

BRIEF DESCRIPTION OF DRAWINGS

The invention is explained in further detail hereafter on the basis of an exemplary embodiment.

The following are shown.

DETAILED DESCRIPTION

FIGS. 1 to 4 show sections of a closing aid 1 for a motor vehicle lock in order to be able to move the rotary latch by motorized force, preferably by means of an electrical drive directly or indirectly from the preliminary latching position and the main latching position.

Figure 1:
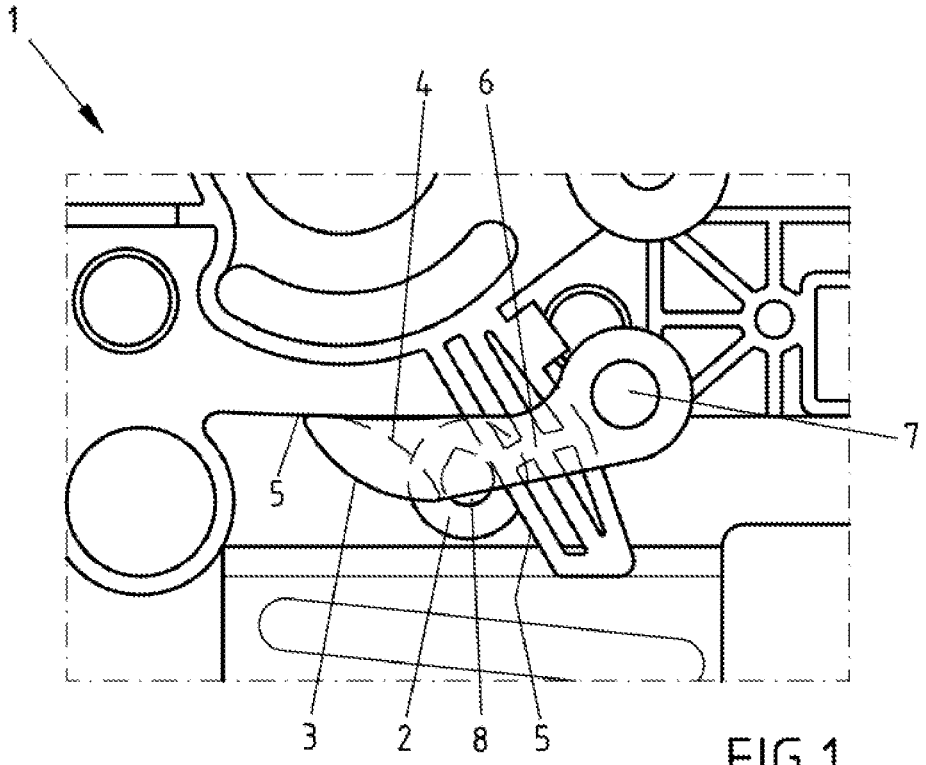
FIG. 1 Closing aid with a closing pawl in its initial position.
Figure 3:
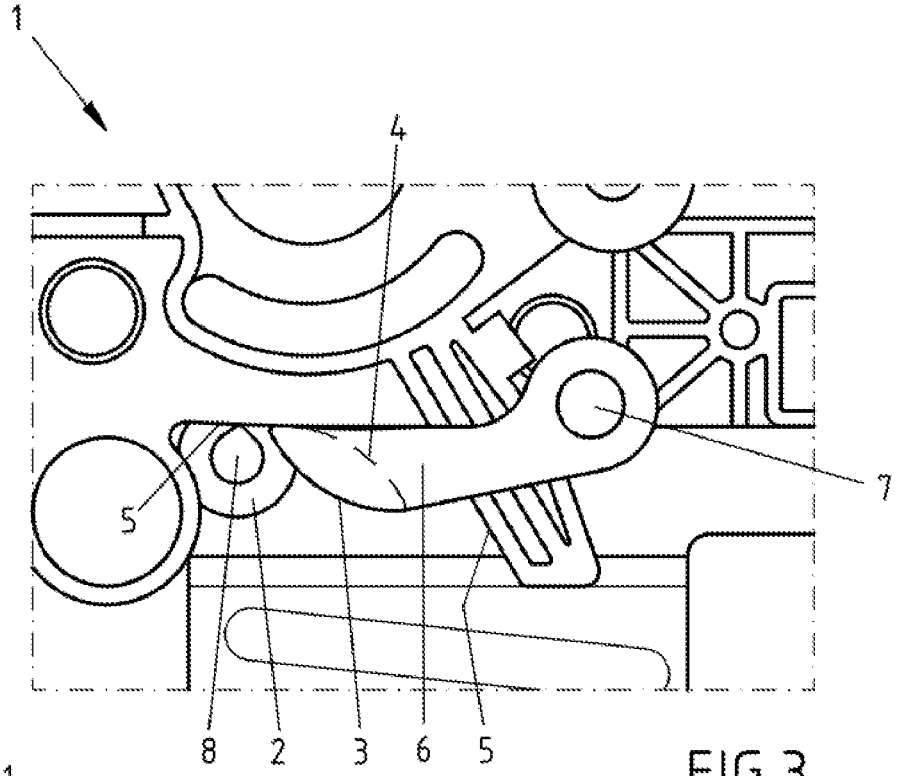
FIG. 3 Closing aid with closing pawl in its end position.
Figure 4:
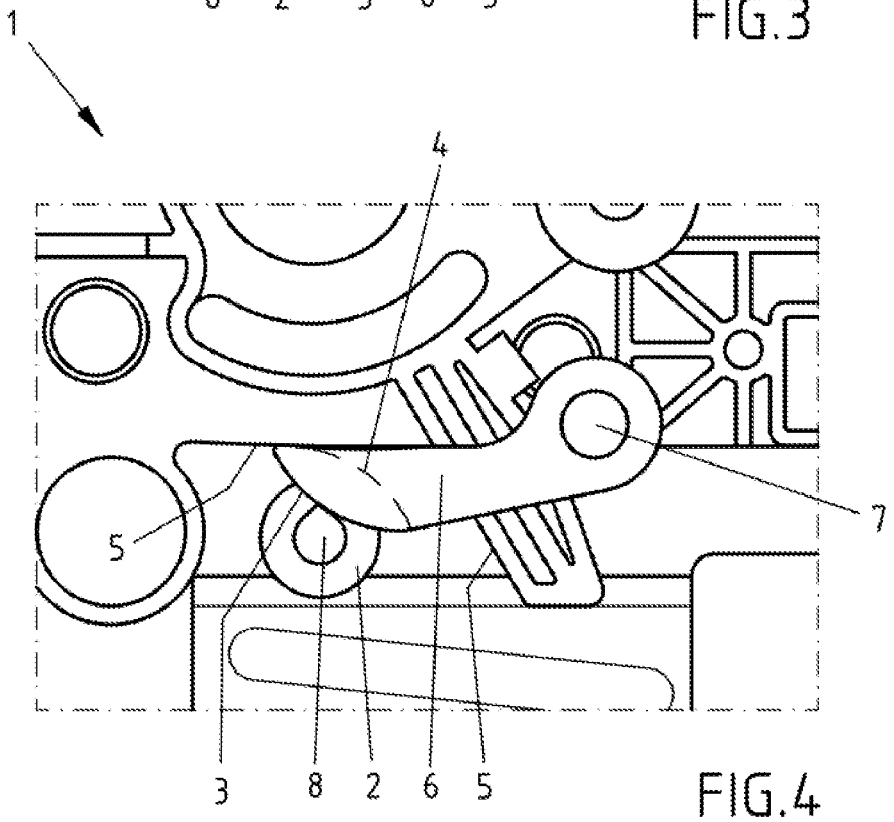
FIG. 4 Closing aid with closing pawl during its movement along a second path in the direction of the initial position.

The closing aid encompasses a movable closing pawl 2, whereby the closing pawl 2 can be moved for closure from an initial position shown in FIG. 1 into an end position shown in FIG. 3 along a first path. FIG. 3 shows the closing pawl 2 on its first path to go from the initial position to the end position. The return motion of the closing pawl 2 from the end position into the initial position occurs along another second path. FIG. 4 shows the closing pawl 2 on its second path to go from its end position back to the initial position. The second path runs differently to the first path so that two different paths are shown for the purpose of the present invention.

Movement of the closing pawl 2 along the first and second path is controlled by several control contours 3, 4 and 5.

A first control contour 4 and a second control contour 3 are attached on a pivotably accommodated lever 6. The lever 6 can be pivoted around its axis 7. The first control contour 4 and the second control contour 3 are movably accommodated due to their attachment on the pivotable lever 6.

Figure 2:
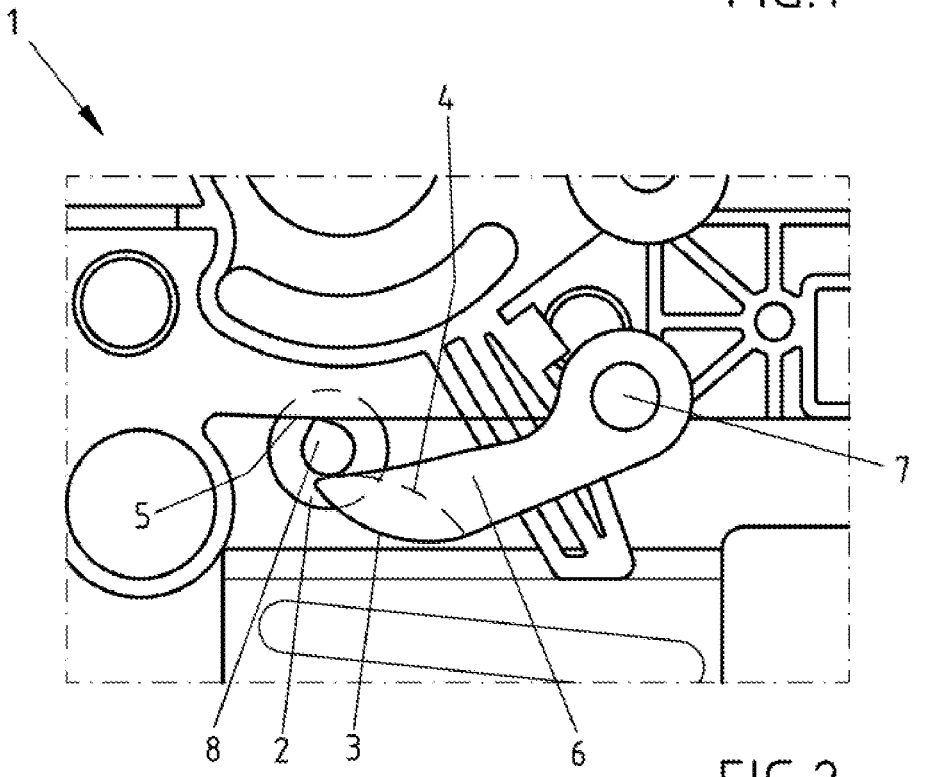
FIG. 2 Closing aid with closing pawl during its movement along a first path in the direction of the end position.

Movement of the closing pawl 2 along the first path runs in such a way that the closing pawl 2 lies adjacent during movement on the first mobile control contour 4 and on the third immobile control contour 5, as is illustrated in particular by FIG. 2. Movement of the closing pawl 2 along the second path runs in such a way that the closing pawl 2 lies adjacent on the second control contour 3 in the course of the movement, as shown in FIG. 4.

The first and the second mobile control contour 4, 3 and the closing pawl 2 can be moved by the force of pre-tensioned, non-illustrated springs in the direction of the firmly attached, and thus immobile, control contour 5. The two springs ensure inter alia that, as shown in FIG. 2, the bolt 8 of the closing pawl 2 which is drop-shaped in the cross-section lies adjacent on the immobile control contour 5 and the first control contour 4 lies adjacent on the other side of the bolt 8. As shown in FIG. 4, it is ensured that the first control contour 4 lies adjacent on the control contour 5 and the bolt 8 of the closing pawl 2 lies adjacent on the second control contour 3. Hereby it is therefore reliably ensured overall that the closing pawl 2 is moved along the first and second path in the desired manner and attains its end position or initial position in the envisaged manner.

The pivotable lever 6 is initially pivoted in a first rotational direction opposite to the clockwise direction when the closing pawl 2 is moved from the initial position into the end position along the first path. If the closing pawl 2 has covered an adequate distance of the first path, the pivotable lever 6 is thus pivoted back again, i.e. in a clockwise direction. When the closing pawl 2 has reached its end position, the pivotable lever 6 is thus pivoted back completely again. The first control contour 4 lies adjacent on the immobile control contour 5 which is ensured by the force of one of the stated pre-tensioned springs.

Both mobile control contours form an oval shape or at least a shape similar to an oval. In interplay with the bolt 8 of the closing pawl 2 which is drop-shaped in the cross-section this shape ensures that the closing pawl 2 is moved along a first path for closure and for movement back into the initial position along a second path which is different from the first path.

The immobile control contour 5 has a leg that serves as a stop for the bolt 8 if the closing pawl 2 is moved back into its initial position. FIG. 1 illustrates that one leg of the control contour 5 prevents the closing pawl 8 being able to be moved further to the right. In this regard, this leg of the control contour 5 forms a stop for the closing pawl 2. The further leg of the control contour 5 controls the movement along the first path, as illustrated in FIG. 2, as then the bolt 8 of the closing pawl 2 lies adjacent on this second leg of the control contour 5.

Along the first path the bolt 8 and thus the closing pawl 2 is guided by two control contours by the first mobile control contour 4 and the immobile control contour 5.

Figure 5:
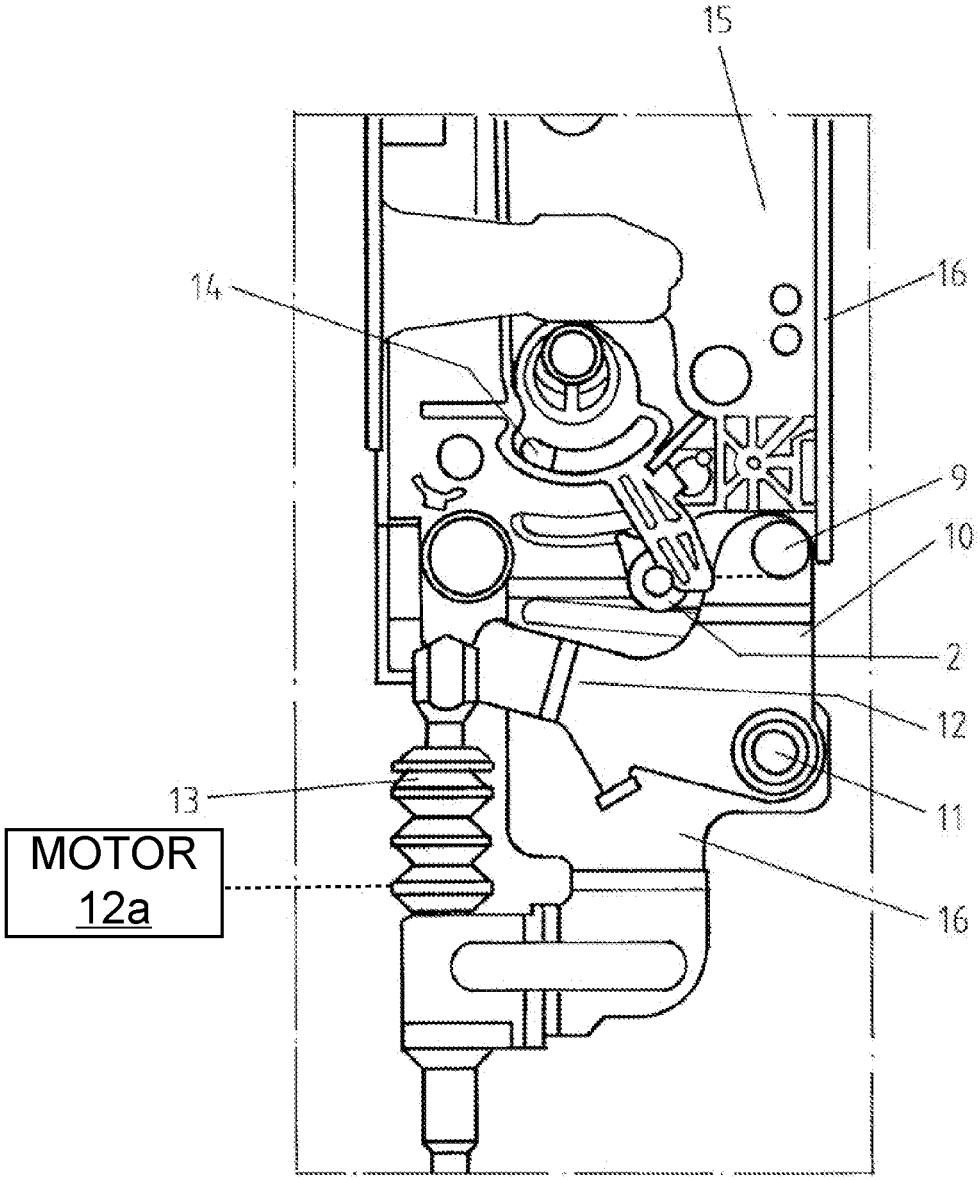
FIG. 5 Lock with closing aid.

The closing pawl 2 is pivotably accommodated by an axis 9 shown in FIG. 5. In FIG. 5, the closing pawl 2 is shown from the opposite side compared to FIGS. 1 to 4. Movement of the closing pawl 2 along the first path and the second path encompasses a rotary movement of the closing pawl 2 around its axis 9.

Furthermore, the axis 9 is shifted, therefore changes the location of the axis 9. As shown in FIG. 5, the axis 9 is attached on an end of the lever arm 10 of a lever which is pivotably accommodated by an axis 11. A further lever arm 12 of this lever can be pivoted around the axis 11 with the aid of a Bowden cable 13 and an electromotor 12*a* in order to thus shift, i.e. relocate, the axis 9 of the closing pawl 2. The axis 9 of the closing pawl 2 is thus shifted by motorized force. The pivoting of the closing pawl 2 around its axis 9 is controlled by the control contours and is thus not directly caused by motorized force. An electromotor is used as a motor in principle.

During its movement along the first path and thus during closure on a rotary latch 14 the closing pawl 2 lies adjacent so that the rotary latch 14 is pivoted from its preliminary latching position into its main latching position. However, this adjacency is not visible from FIG. 5 as the view is obscured by a lock housing 15. The rotary latch and the pawl of the locking mechanism are pivotably attached on a lock case 16. If the closing pawl 2 is moved back after reaching its end position (see FIG. 3), the closing pawl 2 is thus, as shown in FIG. 4, is lifted prematurely by pivoting around its axis 9 from the control contour 5 and thus also lifted from the rotary latch and thus disengaged. As soon as the closing pawl 2 is lifted from the rotary latch, and has thus been disengaged, the lock can be opened.

An advantage of the invention results, namely that during direct opening of the locking mechanism after closure the pawl can be reopened. It is not necessary for the closure unit to return to its initial position as the closing pawl was moved from the engagement area of the rotary latch. The rotary latch is consequently released directly after closure, the locking mechanism can be unlocked or the lock can be opened without resetting of the closure device needing to be anticipated.

LIST OF REFERENCE SYMBOLS

1: Closing aid
2: Closing pawl
3: Mobile control contour
4: Mobile control contour
5: Control contour
6: Pivotably accommodated lever
7: Axis for the pivotably accommodated lever
8: Bolt of the closing pawl
9: Axis for the pivotable accommodation of the closing pawl
10: Lever arm
11: Axis
12: Lever arm
13: Bowden cable
14: Rotary latch

The invention claimed is:

1. A closing aid for a motor vehicle lock having a rotary latch which is configured to be ratcheted in a preliminary latching position and in a main latching position, the rotary latch being moveable by a motorized force from the preliminary latching position and the main latching position, the closing aid comprising:

a closing pawl movable for closure by the motorized force, whereby the closing pawl is configured to be moved for closure from an initial position into an end position along a first path, wherein a return motion of the closing pawl from the end position into the initial position occurs along a second path that is different relative to the first path, wherein the closing pawl is guided along the first path and the second path by two control contours, wherein one of the two control contours, which together guide the closing pawl along the first path and the second path, is immobile.

2. The closing aid according to claim 1, wherein the two control contours includes a first control contour and a second control contour, wherein the closing aid further includes a third control contour, wherein movement of the closing pawl along the first path runs such that the closing pawl lies adjacent on the first and/or the third control contour and/or movement of the closing pawl along the second path runs such that the closing pawl lies adjacent on the second control contour.

3. The closing aid according to claim 2, wherein the first control contour and the second control contour are mobile and pivotably accommodated around an axis.

4. The closing aid according to claim 3, wherein the first control contour and the second control contour are attached on a pivotably accommodated lever.

5. The closing aid according to claim 4, wherein the first control contour and/or the second control contour and/or the closing pawl are configured to be moved in a direction of the third control contour.

6. The closing aid according to claim 5, wherein the pivotably accommodated lever is only pivoted when the closing pawl is moved from the initial position into the end position.

7. The closing aid according to claim 3, wherein the two control contours have an oval shape.

8. The closing aid according to claim 1, wherein the closing pawl is pivotably accommodated by an axis and movement of the closing pawl along the first path and/or the second path encompasses a pivoting movement around the axis and a relocation of the axis.

9. The closing aid according to claim 8, wherein the axis of the closing pawl is shifted by the motorized force.

10. The closing aid according to claim 1, wherein the closing pawl has a protruding bolt with a circular or drop-shaped cross-section and is capable of being guided by the control contours and the protruding bolt.

11. A lock with the closing aid according to claim 1, further comprising the rotary latch, which is configured to be ratcheted in the preliminary latching position and in the main latching position, whereby the closing aid moves the rotary latch from the preliminary latching position and the main latching position via the motorized force acting on the closing aid.

12. The lock according to claim 11, wherein the closing pawl lies adjacent on the rotary latch during closure.

13. A closing aid for a motor vehicle lock having a rotary latch which is configured to be ratcheted in a preliminary latching position and in a main latching position, the rotary latch being moveable by a motorized force from the preliminary latching position and the main latching position, the closing aid comprising:

a closing pawl movable for closure by the motorized force, whereby the closing pawl is configured to be moved for closure from an initial position into an end position along a first path, wherein a return motion of the closing pawl from the end position into the initial position occurs along a second path that is different relative to the first path, wherein movement of the closing pawl is controlled by several control contours including a first control contour, a second control contour, and a third control contour, wherein the first control contour and the second control contour are attached on a pivotably accommodated lever, wherein movement of the closing pawl along the first path runs such that the closing pawl lies adjacent on the first and/or the third control contour and/or movement of the closing pawl along the second path runs such that the closing pawl lies adjacent on the second control contour, wherein the first control contour and the second control contour are mobile and pivotably accommodated around an axis, wherein the first control contour and/or the second control contour and/or the closing pawl are configured to be moved in a direction of the third control contour, and wherein the pivotably accommodated lever is only pivoted when the closing pawl is moved from the initial position into the end position.

* * * * *